US008959746B2

(12) United States Patent
Guzman

(10) Patent No.: US 8,959,746 B2
(45) Date of Patent: Feb. 24, 2015

(54) DEVICE AND METHOD TO ATTACH HEAD GEAR TO A SURFACE

(76) Inventor: Jerry Guzman, Hacienda Heights, CA (US)

( * ) Notice: Subject to any disclaimer, the term of this patent is extended or adjusted under 35 U.S.C. 154(b) by 525 days.

(21) Appl. No.: 13/293,047

(22) Filed: Nov. 9, 2011

(65) Prior Publication Data

US 2012/0052237 A1 Mar. 1, 2012

Related U.S. Application Data

(63) Continuation-in-part of application No. 29/349,515, filed on May 17, 2010, now abandoned.

(51) Int. Cl.

| | |
|---|---|
| ***G09F 7/04*** | (2006.01) |
| ***B44F 3/00*** | (2006.01) |
| ***B44C 5/00*** | (2006.01) |

(52) U.S. Cl.

CPC ..... *B44C 5/00* (2013.01)

USPC ..... 29/525.01; 29/428; 29/432

(58) Field of Classification Search

CPC ..... B44C 5/00; B44C 5/005; B44C 1/00

USPC ..... 29/525.01, 428, 432

See application file for complete search history.

(56) References Cited

U.S. PATENT DOCUMENTS

2011/0265248 A1* 11/2011 Hunt-Martin et al. ..... 2/209.13

* cited by examiner

*Primary Examiner* — Brent O'Hern

(74) *Attorney, Agent, or Firm* — John D. Tran; Rhema Law Group, P.C.

(57) ABSTRACT

The inventive subject matter is to provide a device and method to attach a head gear to a surface where said head gear is a replica of a group consisting of a football helmet, baseball helmet, hockey helmet, motorcycle helmet, race car helmet, bicycle helmet, paint ball helmets, lacrosse helmets, and boxing head gear.

4 Claims, 5 Drawing Sheets

DEVICE AND METHOD TO ATTACH HEAD GEAR TO A SURFACE

This invention is a Continuation-In-Part of U.S. patent application Ser. No. 29/349,515 filed on May 17, 2010.

BACKGROUND OF THE INVENTION (1) Field of the Invention

The field of the invention is related to replicas of head gear. In particular, a device and method for attaching a replica head gear to a variety of surfaces.

(2) Description of Related Art

Modernly, Sports is a multi-billion dollar industry which brings all people from different walks of life together to participate, watch and cheer for their favorite teams. Not surprisingly, fans love to the ability to display their devotion to their respective teams by wearing replica uniforms and jerseys. For major sports such as football, baseball and hockey, which require the use of helmets during the games, fans often purchase replica helmets to display around the house or to wear at games.

Conveniently, manufacturers began producing smaller replica of head gear such helmets that cost less and makes it easier to display due to its smaller footprint. In view of this, it is common to see replicas of such helmets on people's mantles or on desks or somewhere to allow the replica helmet to sit on a flat horizontal surface.

Although ideal for their above normal uses, the current replica helmets do not allow fans that desire the ability to attach or mount their replica helmets on more vertical surfaces such as a refrigerator door, car window, regular door or window etc . . . Instead, because of the said limitations, fans are relegated to use stickers or other similar applications that fail to provide an authentic feel that is desirable to rabid sport fans.

Thus, there is still a need for a device and method to allow a user to attach a replica head gear such as a helmet to a variety of vertical surfaces.

SUMMARY OF THE INVENTION

In light of the above, the inventor has discovered a device and method that solves the issues addressed above. In these respects, the inventive subject matter provides for a device and method to attach a head gear to a surface.

In a particularly preferred embodiment of the contemplated device, the device and method to attach a head gear to a surface comprising a head gear, means for attachment, and a surface.

In some preferred embodiments of the contemplated device and method, the head gear comprising of replicas preferably of helmets worn in such sports as football, baseball, hockey, motorcycling, race car driving, bicycling, paint ball, lacrosse, and boxing but other replica head gear are also acceptable and within the scope of the claimed invention. The replicas of the helmets can consist of different sizes, shapes and colors.

Any referenced patents, applications and literatures are incorporated herein by reference to their entirety. Furthermore, where a definition or use of a term in a reference, which is incorporated by reference herein, is inconsistent or contrary to the definition of that term provided herein, the definition of that term provided herein applies and the definition of the term in the reference does not apply. The inventive subject matter may seek to satisfy one or more of the above-mentioned desires. Although the preferred embodiment of the inventive subject matter may obviate one or more of the above-mentioned desires, it should be understood that some aspects of the inventive subject matter might not necessarily obviate them.

In these respects, a device and method to attach a head gear to a surface of the inventive subject matter substantially departs from the conventional concepts and designs of the prior art, and so doing provides a device and method to attach a head gear to a surface that are not anticipated, rendered obvious, suggested, or even implied by any of the prior art either alone or in combination thereof

DETAILED SUMMARY OF THE INVENTION

In view of the foregoing disadvantages inherent in the known types of prior art, the general purpose of the preferred embodiment of the inventive subject matter, which will be described subsequently in greater detail, is to provide a device and method to attach a head gear to a surface.

Another object of the preferred embodiment of the inventive subject matter is to provide a device and method to attach a head gear to a surface wherein said surface can be such things a window, car window, automobiles, refrigerator, doors and walls;

Another object of the preferred embodiment of the inventive subject matter is to provide a device and method to attach a head gear to a surface where said head gear is a replica of a group consisting of a football helmet, baseball helmet, hockey helmet, motorcycle helmet, race car helmet, bicycle helmet, paint ball helmets, lacrosse helmets, and boxing head gear.

Another object of the preferred embodiment of the inventive subject matter is to provide a device and method to attach a head gear to a surface wherein said replica helmet can be cut in half whereas allowing both sides of the replica helmet to be attached to a surface;

Another object of the preferred embodiment of the inventive subject matter is to provide a device and method to attach a head gear to a surface which allows for easy attachment means for securing said head gear to a surface;

Another object of the preferred embodiment of the inventive subject matter is to provide a device and method to attach a head gear to a surface wherein said attachment means can be easily removed and replaced;

There has thus been outlined, rather broadly, the more important features of the present invention in order that the detailed description thereof may be better understood, and in order that the present contribution to the art may be better appreciated. There are additional features of the inventive subject matter that will be described hereinafter.

In this respect, before explaining at least one embodiment of the present invention in detail, it is to be understood that the invention is not limited in its application to the details of the construction and to the arrangements of the components set forth in the following description or illustrated in the drawings. The subject matter of the present invention is capable of other embodiments and of being practiced and carried out in various ways. Also, it is to be understood that the phraseology and terminology employed herein are for the purpose of the description and should not be regarded as limiting. To accomplish the above and related objects, this inventive subject matter may be embodied in the form illustrated in the accompanying drawings, attention being called to the fact, however, that the drawings are illustrative only, and that changes may be made in the specific construction illustrated.

BRIEF DESCRIPTION OF THE DRAWING(S)

Various other objects, features and attendant advantages of the preferred embodiment of the inventive subject matter will become fully appreciated as the same becomes better understood when considered in conjunction with the accompanying drawings, in which like reference characters designate the same or similar parts throughout the several views, and wherein.

DETAILED DESCRIPTION OF THE DRAWINGS

The invention and its various embodiments can now be better understood by turning to the following detailed description of the preferred embodiments, which are presented as illustrated examples of the invention defined in the claims. It is expressly understood that the invention as defined by the claims may be broader than the illustrated embodiments described below.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed herein even when not initially claimed in such combinations.

Figure 1:
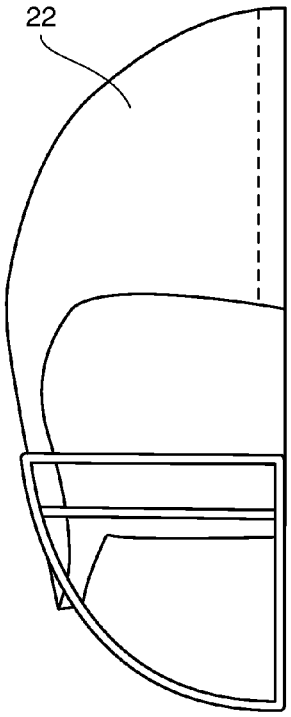
FIG. 1 is a front view depicting a device and method to attach a head gear to a surface according to the present invention in one embodiment which includes said head gear being a football helmet that is split in half to allow an attachment means to be coupled to the inside of the head gear.
Figure 2:
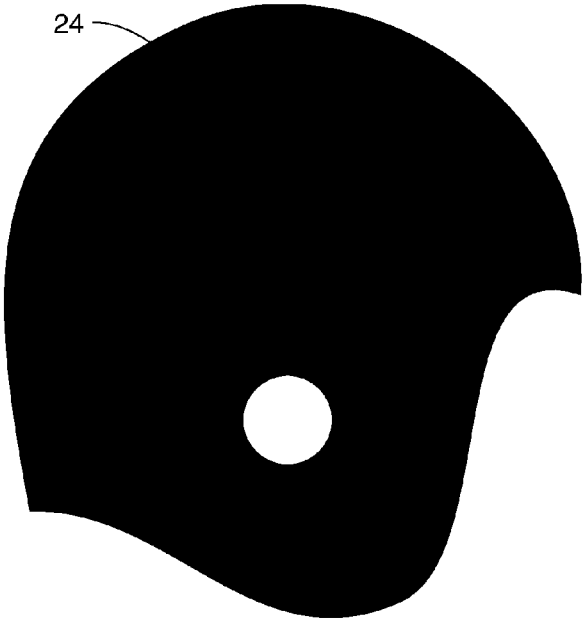
FIG. 2 is a side view depicting a device and method to attach a head gear to a surface according to the present invention in one embodiment showing said attachment means.
Figure 3:
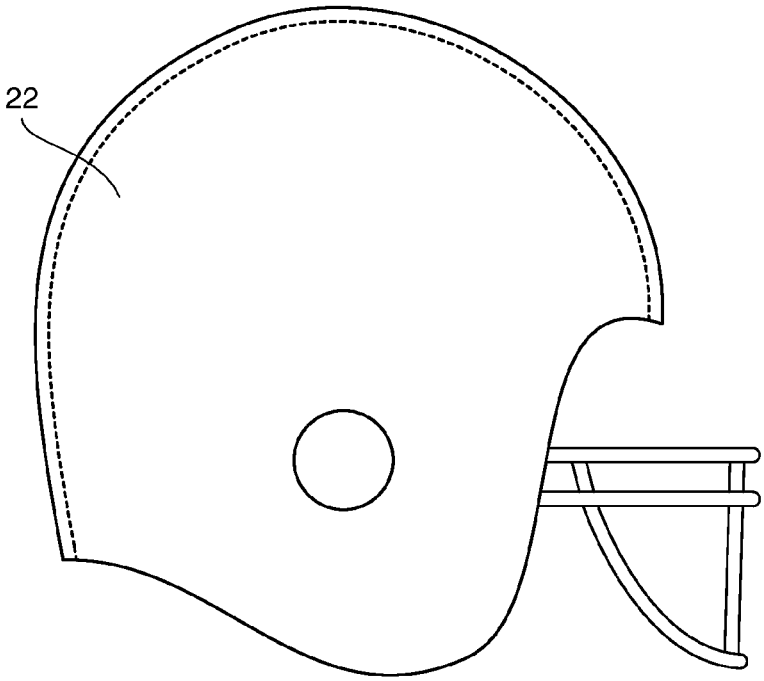
FIG. 3 is a side view depicting a device and method to attach a head gear to a surface according to the present invention in one embodiment showing the visible head gear side.
Figure 4:
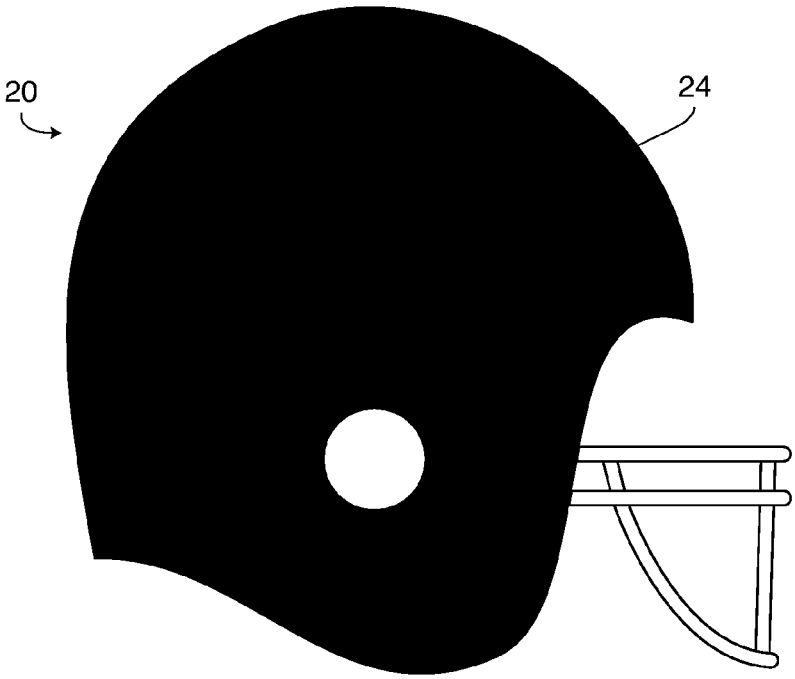
FIG. 4 is a side view depicting a device and method to attach a head gear to a surface according to the present invention in one embodiment showing the inside of the head gear depicted in FIG. 3.

Referring now to the drawings, which are provided by way of illustration and example, and wherein like reference numerals designate like or corresponding elements among the several views, there is shown in FIG. 1, a device and method of attaching a head gear to a surface comprising a head gear 22 being consisting of a group selected from a football helmet, baseball helmet, hockey helmet. The head gear 22 shown in FIG. 1, for illustration purposes only, is a replica mini- football helmet but such head gear can be of any helmet that can be split in half In one embodiment, the head gear 22 can be split in half during the manufacturing process of the helmet or after purchase if the user has the proper equipment. The ability to split the head gear 22 in half provides the advantages of allowing both portions or halves of the head gear 22 the ability to be attached to a surface by an attachment means. FIG. 2 shows one embodiment of an attachment means to attach said head gear 22 to a surface. In a preferred embodiment, the attachment means 24 can be in the form of a sticker, magnet, hook and fastener that is coupled securely to the exposed inside portion of the head gear 22. Preferably, the attachment means 24 can be made to closely fit the shape of the head gear 22. Turning to FIG. 3, a contemplated embodiment is shown depicting half of the head gear 22 that is exposed and seen when attached to a surface. FIG. 4 shows the same head gear as seen in FIG. 3 but flipped to show the attachment means 24 securely attached to said head gear 22 in one present embodiment.

Figure 5:
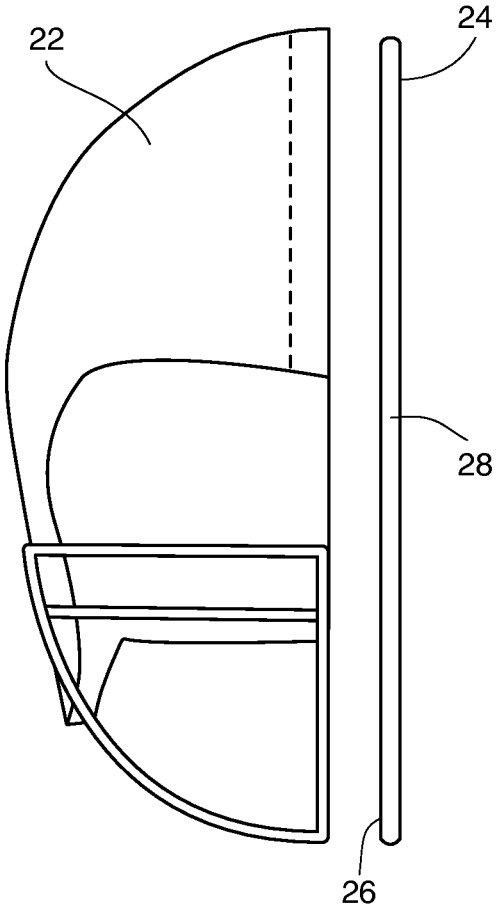
FIG. 5 is a front view depicting a device and method to attach a head gear to a surface according to the present invention in one embodiment showing half of said head gear being a football helmet and said attachment means before coupling.
Figure 6:
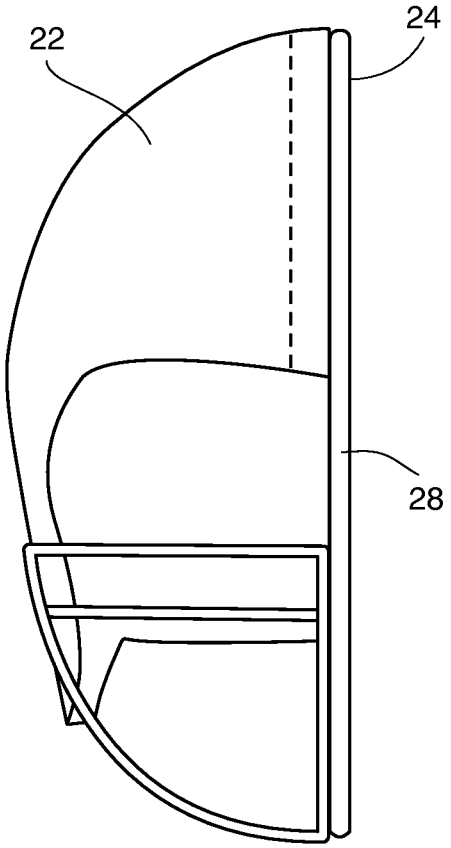
FIG. 6 is a front view depicting a device and method to attach a head gear to a surface according to the present invention in one embodiment showing half of said head gear being a football helmet and said attachment means after coupling.

As seen in FIG. 5, the attachment means 24 is coupled to the inside of the head gear 22 by the inner portion of the attachment means 26. As seen clearly in FIG. 6, in one embodiment, coupling can occur by a variety of ways such as glue, or another type of bonding material. Alternative coupling means can include hook and fastener, nails and/or screws. The other side of the attachment means 28 may vary depending on the desired surface area. For example, if the desired surface area is a window such as a car window or glass window, the attachment means surface 24 can be comprised of a sticky-type of adhesive to ensure that the head gear 22 is securely affixed to the glass without slippage or unwanted detachment. In an alternative embodiment, if the desired surface area is metal such as a refrigerator door, then the attachment means surface 28 can be in the form of a magnet to ensure the head gear 22 is securely affixed to the metal surface area. Depending on the desired surface area, alternative embodiments of the attachment means surface 28 may change to accommodate different surface areas.

Figure 7:
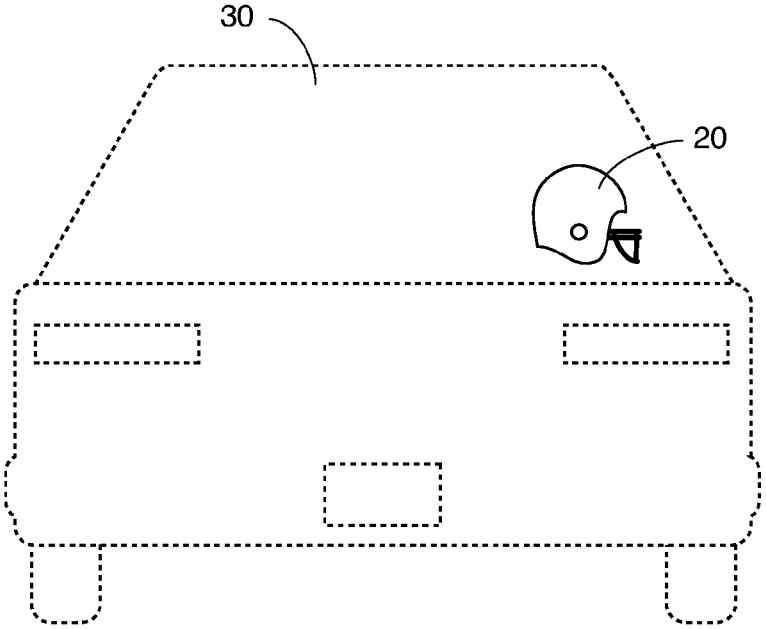
FIG. 7 is a view depicting a device and method to attach a head gear to a surface according to the present invention in one embodiment showing said head gear being attached to a vertical surface such as on a car window.
Figure 8:
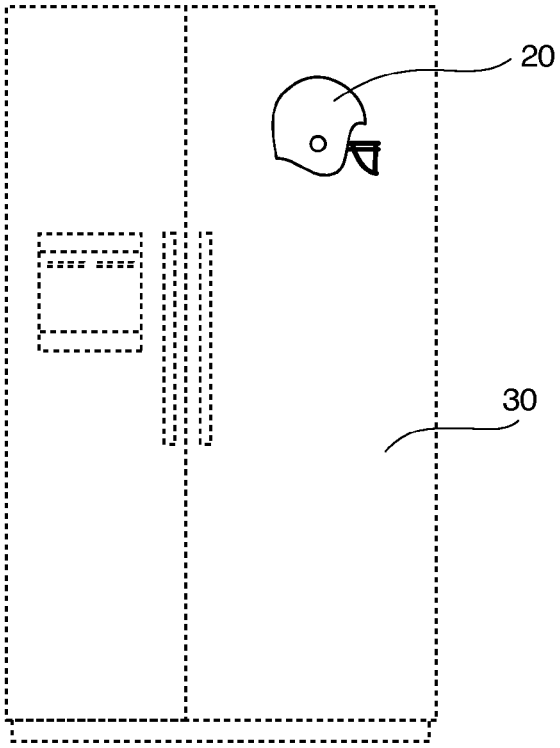
FIG. 8 is a view depicting a device and method to attach a head gear to a surface according to the present invention in one embodiment showing said head gear being attached to a vertical surface such as on a refrigerator.

FIG. 7 shows one preferred embodiment of the device and method to attach a head gear 20 to a surface comprising of the head gear being attached to the surface of a car window. FIG. 8, shows another embodiment of the device and method to attach a head gear 20 to a surface comprising of the head gear being attached to the surface of a refrigerator.

In a preferred embodiment, device and method to attach a head gear to a surface includes a variety of different attachment means that can be interchanged depending on the desired surface area that the head gear will be attached to.

Thus, specific embodiments and applications of the device and method to attach a head gear to a surface have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A method for attaching a replica head gear to a vertical surface, the method comprising:

a. splitting said replica gear in half;

b. providing said half of the replica head gear with means for attachment;

c. said means for attachment being coupled to said vertical surface area which is selected from a group consisting of an adhesive, magnet, hook and loop fastener, nails, screws, or buttons.

2. The method of claim 1 wherein said replica head gear is selected from a group consisting of a football helmet, baseball helmet, hockey helmet, motorcycle helmet, race car helmet, bicycle helmet, paint ball helmets, lacrosse helmets, and boxing head gear.

3. The method of claim 1 wherein both halves of the replica hear gear is coupled with said means for attachment.

4. The method of claim 1 wherein said vertical surface is selected from a group consisting of a window, car window, refrigerator, door, wall, automobile door, and automobile bumper.

* * * * *